United States Patent [19]

Aoki

[11] 4,089,161

[45] May 16, 1978

[54] WRIST BAND

[75] Inventor: Ryozo Aoki, Tokyo, Japan

[73] Assignee: Citizen Watch Company Limited, Tokyo, Japan

[21] Appl. No.: 759,957

[22] Filed: Jan. 17, 1977

[30] Foreign Application Priority Data

Jan. 21, 1976 Japan ..... 51-6095[U]
Mar. 30, 1976 Japan ..... 51-38391[U]

[51] Int. Cl.[2] ..... F16G 13/18
[52] U.S. Cl. ..... 59/80
[58] Field of Search ..... 59/80, 82, 35, 81; 74/235; 63/4

[56] References Cited

U.S. PATENT DOCUMENTS

| | | | |
|---|---|---|---|
| 1,495,228 | 5/1924 | Koenemann | 74/235 |
| 2,610,463 | 9/1952 | Prestinari | 59/80 |
| 3,529,416 | 9/1970 | King | 59/80 |
| 3,690,064 | 9/1972 | Pompeo | 59/80 |

FOREIGN PATENT DOCUMENTS

| | | | |
|---|---|---|---|
| 969,262 | 5/1950 | France | 59/80 |
| 1,120,195 | 12/1961 | Germany | 59/81 |
| 1,246,865 | 9/1971 | United Kingdom | 59/81 |

*Primary Examiner*—C.W. Lanham
*Assistant Examiner*—Gene P. Crosby
*Attorney, Agent, or Firm*—Frank J. Jordan

[57] ABSTRACT

A flexible link chain in which a plurality of transversely spaced end lugs are connected to each other by a plurality of connecting rods, on which center sheaths are rotatably disposed to rotatably support center links, respectively, which are disposed between the transversely spaced end lugs.

12 Claims, 18 Drawing Figures

Fig. 4
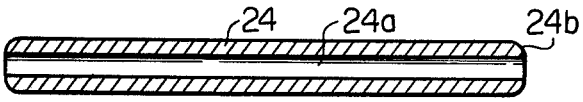
Fig. 5
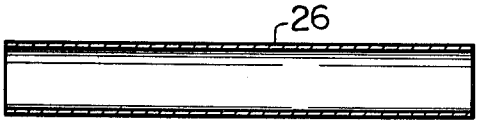
Fig. 6a
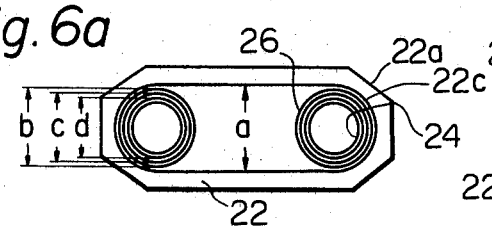
Fig. 6b
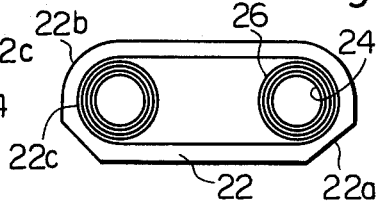
Fig. 6c
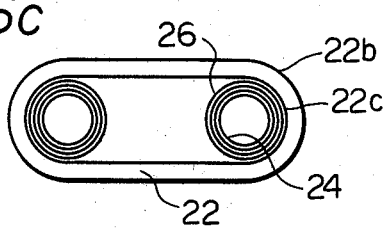
Fig. 6d
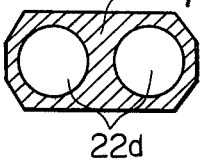
Fig. 7a
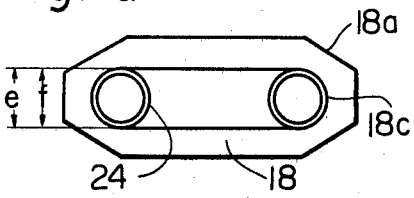
Fig. 7b
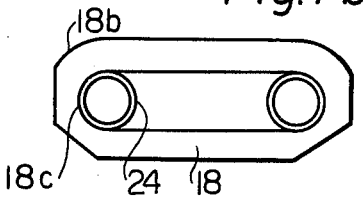
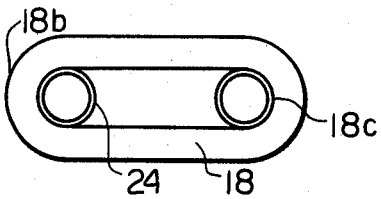
Fig. 7c
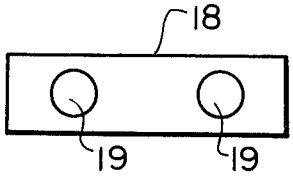
Fig. 7d

WRIST BAND

This invention relates to tapered link chains or bands such as are utilized for wrist watches, bracelets or like jewelry.

In conventional wrist watches, it has been a common practice to employ a link chain or band which is composed of twin rod link-halves and central link halves. To provide a flexibility to the link chain or the band, it has been a usual practice to pass the link chain through a pair of rolls. This rolling procedure is laborious, time consuming, and uneconomical. Another drawback is encountered with this prior art link chain in that it has a low flexibility due to inherent construction on the connecting rod.

It is, therefore, an object of the present invention to provide an improved wrist band which can overcomes shortcomings encountered in the prior art.

It is another object of the present invention to provide an improved wrist band which provides an increased flexibility.

It is another object of the present invention to provide an improved wrist band which is simple in construction, easy to assemble and low in manufacturing cost.

It is still another object of the present invention to provide an improved wrist band which is slender and light in weight.

It is a further object of the present invention to provide an improved wrist band which will not fray or otherwise harm the shirt cuffs of a user.

It is a still further object of the present invention to provide an improved wrist band in which complicated pressing procedures following wrist band assembly are no longer required.

These and other objects, features and advantages of the present invention will become more apparent from the following description when taken in conjunction with the accompanying drawings, in which:

FIG. 4 is an enlarged cross section of a connecting rod forming part of the link band shown in FIG. 3;

FIG. 5 is an enlarged cross sectional view of a center sheath cooperating the connecting rod shown in FIG. 4.

Figure 3:
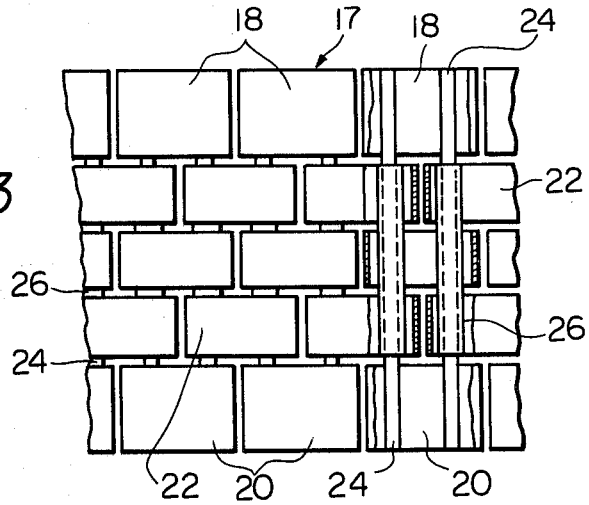
FIG. 3 is an enlarged fragmentary view illustrating still another preferred embodiment of a link band according to the present invention.
Figure 8A:
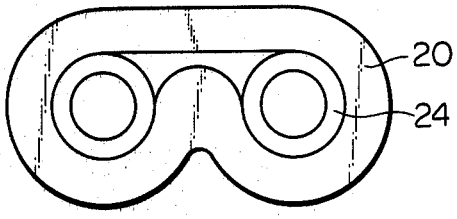
Figure 8B:
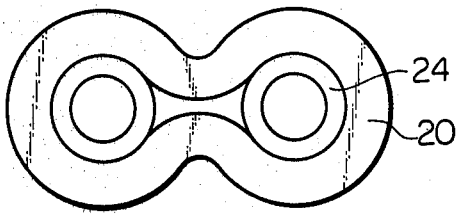
Figure 10:
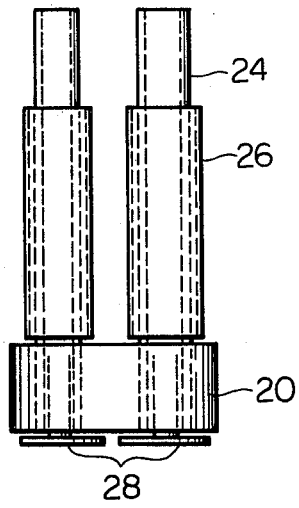
Figure 9:
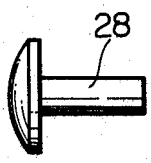

FIGS. 6*a* to 6*d* are enlarged side views showing various examples of a center link forming part of the link band shown in FIG. 3;

FIGS. 7*a* to 7*d* are enlarged side views showing various examples of an end lug forming part of the link band shown in FIG. 3;

FIGS. 8*a* and 8*b* are enlarged side views showing other examples of the end lug shown in FIG. 3;

FIG. 9 is an enlarged side view of a force fitted pin to be used for the link band shown in FIG. 3; and FIG. 10 is a partial plan view of a force fitted pin in the state of use.

Figure 1:
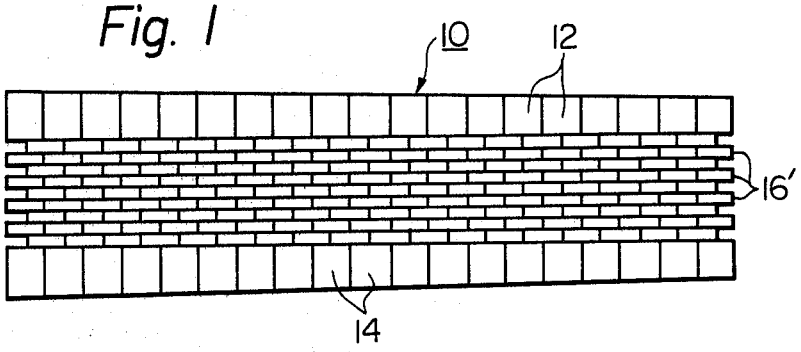
FIG. 1 is a top plan view of one preferred embodiment of a flexible link band according to the present invention.

Referring first to FIG. 1, a wrist watch band or chain is shown which has a chain of tapered link 10. As shown, the tapered link 10 has two end lugs 12 and 14 which are connected to each other, and a plurality of center links 16 are provided between the end lugs.

Figure 2:
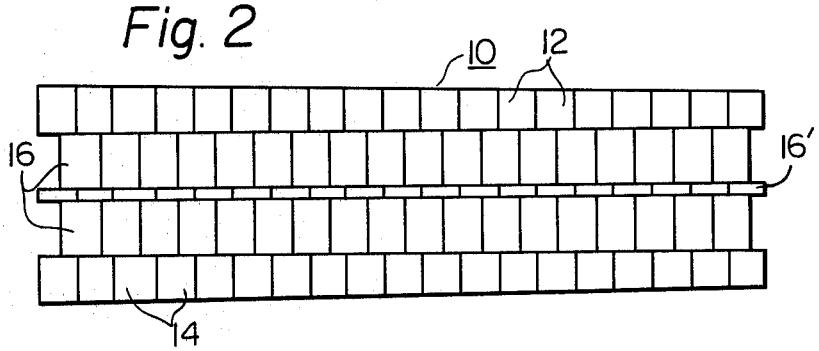
FIG. 2 is a top plan view of another preferred embodiment of a link band according to the present invention.

FIG. 2 shows another specific embodiment of a wrist watch band. In this illustrated embodiment, the tapered link 10 is shown to have end lugs 12 and 14 between which relatively wide center links 16 and a narrow center link 16' are disposed.

FIG. 3 shows an enlarged fragmentary view of a further specific embodiment of a watch band according to the present invention. In FIG. 3, reference numeral 22 denotes a center link which forms the intermediate portion of a watch band 17. The center link 22 is rectangular in shape and the interior and exterior surfaces thereof may be provided with tapered portions 22*a* and rounded portions 22*b*, 22*c* alone or in combination as shown in FIGS. 6*a* to 6*c* although it is desirable to employ center links which are slender is cross section in order to obtain a watch band which is slender and light in weight. The center link 22 may be of the type shown in FIG. 6*a*, in which the center link 22 has a pair of bores 22*d*. The fact that each center link 22 is provided with external tapered portions 22*a* or rounded portions 22*b* means that a user's shirt cuffs will not be flawed or frayed and assures that adjoining center links will not abut upon each other so as to allow each link to pivot sufficiently. This offers a highly flexible watch band and one which is comfortable to wear.

Reference numeral 24 denotes a connecting rod covered by a rotatable center sheath 26 which acts as an intermediary so that the connecting rod may support the center link 22, two of such connecting rods 24 being passed through each center link. The connecting rod 24 is cylindrical as shown in FIG. 4 and the ends thereof are rounded at 24*b* in order to enable the rod to be easily force fitted into a bore of the end lug. The connecting rods are as slender as possible in order to reduce the size and weight of the band. Since the center sheath 26 covers and is rotatable about the connecting rod 24 and is passed through the center link 22 in order to provide it with pivotal support, the outer diameter *b* of the center sheath must be smaller than the diameter *a* across the hollow interior of center link 22, while its inner diameter *c* must be larger than the outer diameter *d* of the connecting rod 24 as shown in FIG. 6*a*. The center sheath should also be as slender as possible. One example of the center sheath 26 is shown in FIG. 5.

It will be appreciated that the connecting rod 24 and the center sheath 26 define an axle upon which the center link 22 may pivot. The center sheath 26 and the connecting 24 rotate independently of each other, thereby to provide the watch band with great flexibility.

Reference numeral 18 denotes an end lug for positioning both ends of each connecting rod 24, two of which are provided for each end lug and fixed at one end thereto. Each end lug is rectangular in shape with holes 19 as shown in FIG. 7*d* and the interior and exterior surfaces thereof may be provided with tapered portions 18*a* and rounded portions 18*b*, 18*c* alone or in combination as shown in FIGS. 7*a* to 7*c* although it is desirable to employ end lugs which are slender in cross section in order to obtain a watch band which is slender and light in weight. When the end of the connecting rod 24 is fit into the lug, the width *e* across the hollow portion of the end lug 18 should be substantially equal to the outer diameter *f* of the connecting rod 24 so that its end is provided with sufficient support. In order to completely fix the end of the connecting rod 24 to the end lug 20, the end lug 20 may be crimped as shown in FIGS. 8*a* and 8*b*. Although the end lugs as shown gradually taper in order to provide a watch band which successively narrows, they may also be chosen to have an identical width throughout.

In FIGS. 9 and 10, reference numeral 28 denotes a force fitted pin which when necessary is driven into the open end of the connecting rod 24 already fitted into the end lug 20. Since the gap are provided in the end lug 18 between the rods 24, as shown in FIGS. 7*a*, 7*b*, 7*c* and 8*a*, 8*b* the band presents a unique side appearance and an outstanding design. However, if the band is to be adapted as an accessory, the design of the watch band can be changed and the image presented by the end lugs altered by driving a force fitted pin 28 into the open end of the connecting rod 24 as shown in FIG. 10.

An assembling process for the embodiment of FIG. 3 will now be described below. Here, a single row of center links 22 are disposed along a row of adjacent end lugs 18 in such a manner that each individual center link 22 spans a pair of adjacent end lugs 18 and 20. Another row of center links is disposed along the preceding row but so positioned as to bring each individual center link into agreement with each respective end lug. This arrangement is successively repeated until a plurality of center links 22 have been so disposed. In order to bring these center links into connection with their neighbors, two cylindrical connecting rods 24 covered by the rotatable sheaths 26 are passed through the interior of each center link, as shown in FIG. 6, and each end of the connecting rods is then fitted into each of the end lugs 18 and 20. Since the gap *e* within the hollow portion of the lug 18 is approximately equal to the outer diameter *f* of the connecting rod 24, the fitted end of the connecting rod will not detach from the end lug; however, one or both faces of the lug are crimped as shown in FIG. 8 to further reinforce the joint. It is also possible when necessary to drive a force fitted pin 28 into the open end of the connecting rod 24 from outside the end lug to thereby close the opening at the end of the connecting rod and seal off the open end of the lug. Thus, each center link 22 is axially supported by the connecting rods 24 the ends of which are fitted into opposing pairs of the end lugs 18 and 20.

According to the watch band as herein described, each center link 22 is pivotally supported by way of a center sheath 26 which is itself free to rotate about a connecting rod 24. Moreover, since the center links are externally provided with tapered portions 22*a* and rounded portions 22*b* as shown in FIG. 6, the watch band is endowed with increased flexibility, comfortable to wear and will not do harm to a user's shirt sleeve when twisted or bent during use.

Thus the present invention offers a watch band which is formed of center links supported by cylindrical connecting rods covered by rotatable center sheaths, and end lugs into which the ends of the connecting rods are fitted. This affords a watch band which can be fabricated without requiring special processing such as press working to provide flexibility and permits the connecting rods to be fitted into the end lugs without the intermediary of a reinforcing member. This permits the watch band to be assembled in a very easy manner and thus reduces the amount of time required. Using pipes as the connecting rods permits the size and weight to be reduced and strength of the band to be increased. The fact that the center links and center sheaths are rotatable with respect to the connecting rods offers a band that is highly flexible and thus comfortable to wear. The tapered or rounded contours assure that the user's shirt cuffs will not suffer from fraying when the band is bent or twisted. Moreover, since both edges of the assembled band can be provided with force fitted pins, it is possible to optionally select any design whatsoever along the edges. The watch band of this invention is also well suited to mass production due to its simplicity in structure and assembly.

While the present invention has been shown and described with reference to particular embodiments by way of example, it should be noted that various other changes or modifications may be made without departing from the scope of the present invention. For example, each of the end lugs may have blind bores instead of through-bores, if desired.

I claim:

1. A wrist watch band comprising:

a plurality of transversely spaced end lugs each having a hollow portion;

a plurality of center links disposed between said transversely spaced end lugs, each of said plurality of center links having a hollow interior;

a plurality of connecting rods, each of which has an outer diameter substantially equal to the width across the hollow portion of each end lug and, two of which extend through each of said center links and are fitted at each end to the hollow portion of each end lug; and a plurality of cylindrical center sheaths disposed on said connecting rods, respectively, and each extending through the hollow interior of each center link, each of said plurality of cylindrical center sheaths having its outer diameter smaller than the diameter across the hollow interior of said each center link and its inner diameter larger than the outer diameter of each connecting rod, whereby said each center sheath is free to rotate about said each connecting rod, thereby to provide the watch band with increased flexibility.

2. A wrist watch band according to claim 1, in which said each end lug is rectangular in shape.

3. A wrist watch band according to claim 2, in which said each end lug is formed with tapered external profile.

4. A wrist watch band according to claim 2, in which said each end lug is provided with a rounded external profile.

5. A wrist watch band according to claim 2, in which said each end lug is provided with tapered and rounded external profiles.

6. A wrist watch band according to claim 2, in which said each center link is rectangular in shape.

7. A wrist watch band according to claim 3, in which said each center link is provided with a tapered external profile.

8. A wrist watch band according to claim 4, in which said each center link is provided with a rounded external profile.

9. A wrist watch band according to claim 5, in which said each center link is proivded with a tapered and rounded external profiles.

10. A wrist watch band according to claim 1, in which each of said connecting rods is cylindrical.

11. A wrist watch band according to claim 10, in which said each connecting rod is provided with rounded ends.

12. A wrist watch band according to claim 10, further comprising a plurality of force fitted pins each driven into both ends of said each connecting rod.

* * * * *